US010779590B2

(12) United States Patent
Quiroga et al.

(10) Patent No.: US 10,779,590 B2
(45) **Date of Patent: *Sep. 22, 2020**

(54) MEDICAL GARMENT FOR CHEST DEVICES AND PROCEDURES

(71) Applicant: The Emilio Nares Foundation, San Diego, CA (US)

(72) Inventors: Luz A. Quiroga, Chula Vista, CA (US); Corina Elizabeth Quiroga Banzer, La Paz (BO)

(73) Assignee: The Emilio Nares Foundation, San Diego, CA (US)

( * ) Notice: Subject to any disclaimer, the term of this patent is extended or adjusted under 35 U.S.C. 154(b) by 299 days.

This patent is subject to a terminal disclaimer.

(21) Appl. No.: 15/885,605

(22) Filed: Jan. 31, 2018

(65) Prior Publication Data

US 2018/0168249 A1 Jun. 21, 2018

Related U.S. Application Data

(63) Continuation of application No. 13/363,104, filed on Jan. 31, 2012, now Pat. No. 9,901,129.

(51) Int. Cl.
*A41D 13/12* (2006.01)

(52) U.S. Cl.
CPC ..... *A41D 13/129* (2013.01); *A41D 13/1245* (2013.01)

(58) Field of Classification Search
CPC ..... A41D 13/1245; A41D 13/129
See application file for complete search history.

(56) References Cited

U.S. PATENT DOCUMENTS

| | | | | |
|---|---|---|---|---|
| 302,901 | A | 8/1884 | Fenne | |
| 818,351 | A | 4/1906 | Clark | |
| 1,489,046 | A * | 4/1924 | Thompson | A41B 9/08 2/114 |
| 2,341,797 | A * | 2/1944 | Lesser | A41B 1/00 2/115 |
| 2,722,686 | A | 11/1955 | Hoskings | |
| 3,611,439 | A * | 10/1971 | Meyers | A41D 1/215 2/54 |
| 4,031,566 | A | 6/1977 | Johnson | |
| 4,434,511 | A | 3/1984 | Weiser | |
| 4,570,268 | A | 2/1986 | Freeman | |
| 4,578,062 | A | 3/1986 | Schneider | |
| 5,048,122 | A | 9/1991 | Prieur | |

(Continued)

*Primary Examiner* — Anna K Kinsaul
(74) *Attorney, Agent, or Firm* — Sheppard Mullin Richter & Hampton LLP

(57) ABSTRACT

Embodiments of the disclosure include a medical garment that resembles a shirt. The medical garment includes a body that includes a front portion attached to a back portion by one or more non-partable seams. The medical garment includes first and second sleeves on opposite sides of the medical garment. The first and second sleeves are coupled to the front portion and the back portion of the medical garment. The medical garment includes a flap formed on the front portion and configured to open to expose a portion of a person. The flap includes a partable seam that extends along a top of the body and a portion of a side of the body down to but not beyond a bottom part of the first sleeve where the first sleeve attaches to the body. The flap further includes a fastener to hold the partable seam in a closed position.

20 Claims, 3 Drawing Sheets

(56) References Cited

U.S. PATENT DOCUMENTS

| | | | | |
|---|---|---|---|---|
| 5,062,159 | A | 11/1991 | Jakub | |
| 5,392,466 | A | 2/1995 | Chou | |
| 5,611,087 | A | 3/1997 | Adkins | |
| 6,216,271 | B1 | 4/2001 | Chen | |
| 6,450,168 | B1 | 9/2002 | Nguyen | |
| 6,647,552 | B1 | 11/2003 | Hogan | |
| 6,973,673 | B2 | 12/2005 | Beuk | |
| 7,181,773 | B1 * | 2/2007 | Piraka | A41D 13/1281 2/114 |
| 7,454,798 | B2 | 11/2008 | Feodoroff | |
| D584,483 | S | 1/2009 | Glynn | |
| 2010/0251456 | A1 | 10/2010 | Bower | |

* cited by examiner

MEDICAL GARMENT FOR CHEST DEVICES AND PROCEDURES

CROSS-REFERENCE TO RELATED APPLICATIONS

This application is a continuation of and claims priority to U.S. patent application Ser. No. 13/363,104, filed Jan. 31, 2012, the contents of which are incorporated herein by reference in their entirety.

BACKGROUND

Discussion of the Related Art

For patients receiving certain medical treatments, it is often necessary to remove clothing to expose body areas for receiving treatment, connect medical devices, or allow access to such medical devices. Many people have aversions to disrobing and wearing hospital medical gowns, often with the feeling that their bodies are prone to unnecessary exposure due to the way the garments are constructed. Others feel that changing into a medical gown is inconvenient and unnecessary when receiving a quick medical procedure. This can be particularly troublesome with young children, as they often will resist multiple changes of clothes or any clothing that is deemed uncomfortable.

For instance, U.S. Pat. No. 7,454,798 to Feodoroff relates to a medical garment configured to be worn by a patient requiring medical attention. The application discloses a blouse portion, a shoulder portion, a torso portion, two arm portions, an open front, and at least one fastener; a breast access panel separate from the open front and extending from the shoulder portion to the waist of the patient, a strip of hook and loop material attached to an inside of the breast access panel; a mating strip of hook and loop material attached to an outside of the torso portion, wherein the breast access panel is configured to be moved between ins open and closed positions while maintaining the open front in its closed position. The configuration of the breast access panel provides much too large of an access area to the wearer's chest.

U.S. Pat. No. 6,647,552 to Hogan discloses a medical dignity garment allowing access to a medical access area of the patient without removal of the garment and closure over the garment while treatment is in progress, comprising a body portion, and front panels having at least one flap, the flap defined by placket, lower, sleeve, and folding edges. The flap can be folded along the folding edge. Due to the configuration of openable edges, the way that the flap opens is not ideal for procedures on the chest area from above in comparison to the present disclosure.

SUMMARY

Thus comes the need for a medical garment that allows a patient to wear the garment in or out of the hospital, while still providing access to the areas needed to receive medical treatment when necessary.

The present embodiments seek to solve problems present in the prior art, including, for example, that many medical garments are not suited to casual wear, and medical garments with access means to the wearer's body often expose a larger area than required, or provide access in such a way that is incompatible with comfortable routing of medical devices or components being used in certain treatments. Such a garment optionally should not resemble a medical garment so that it may be worn casually, and be comfortable to wear when sitting, standing, or laying down.

One aspect of the present embodiments is directed to a medical garment outwardly resembling a t-shirt, adapted to be worn by a person requiring medical attention. The medical garment comprises a flap that covers a portion of the wearer's chest that can be opened or closed as needed to access medical devices on the wearer's chest. The flap is held closed by fasteners affixed on the inside portion of the flap itself and the areas on the back portion and sleeve that the flap overlaps.

One embodiment includes a medical garment that includes a flap that provides access to a wearer's chest without having to remove the medical garment.

Another embodiment can be characterized as a medical garment comprising a front portion attached to a back portion, said front and back portions having an inside surface and an outside surface; a collar located at the top of the front portion and the back portion, configured to surround a neck of the person, and having a first and second shoulder region on each side of said collar, said shoulder regions adapted to surround the shoulders of the person enclosed within said garment and having proximal and distal ends in relation to the collar; at least one sleeve affixed to the front and the back portions and configured to surround at least a portion of an arm of the person, said sleeve having a top and a bottom, and proximal and distal ends in respect to the collar opening; a flap, formed on the front portion, positioned at the top of the front portion and one of the shoulder regions, and configured to open and close to expose a portion of the upper torso of the person when in an open position, comprising a first partable seam extending from the collar, along the one of the shoulder regions, to the top and proximal end of the sleeve; a second partable seam extending from the top and proximal end of the sleeve to the bottom and proximal end of the sleeve; and fasteners to hold the first and second partable seams in the closed position.

Some embodiments may comprise the use of different types of fasteners for holding the flap in the closed position. Depending on the application, hook and loop type fasteners may be preferred due to concerns over comfort when the patient is lying down or sleeping. However, buttons may also be used, as well as zippers or clasps.

Optionally, in accordance with some embodiments, the areas where the flap overlaps the back portion and the sleeve portion, and where the fasteners are attached, are reinforced to withstand numerous openings and closings of the flap. The reinforcements to the areas may optionally be done by folding over of fabric from the respective back or sleeve portions and sewing the folded fabric into place, by the addition of strips of fabric or other material sewn into the areas, or by embedding additional fabric or other material into the overlap areas.

Another exemplary embodiment includes a medical garment comprising a body including a front portion attached to a back portion; a first and second shoulder region coupled to the body; a flap, formed on the front portion of the body and configured to open and close to expose a portion of the upper torso of the person when in an open position, the flap including a partable seam extending along a portion of a top edge of the body and a portion of a side edge of the body; and fasteners to hold the partable seam in the closed position.

BRIEF DESCRIPTION OF THE DRAWINGS

The above and other aspects, features and advantages of the present disclosure will be more apparent from the following more particular description thereof, presented in conjunction with the following drawings, wherein.

Figure 1:
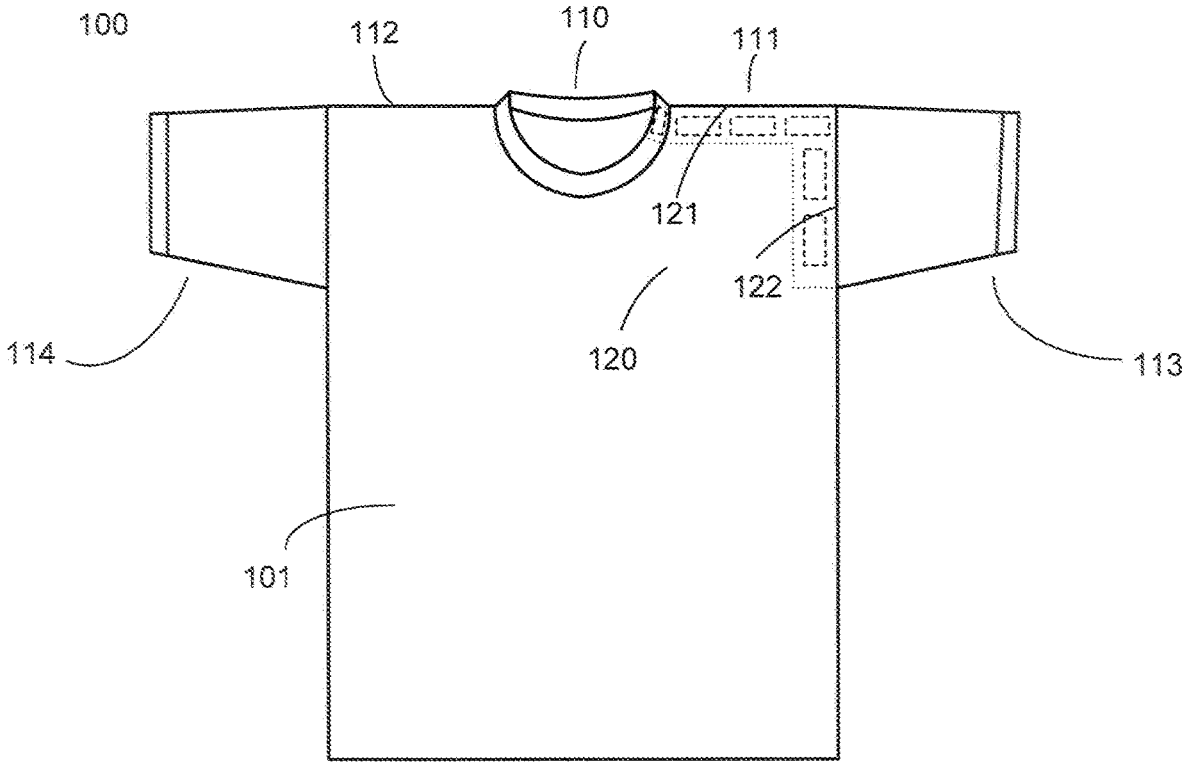
FIG. 1 shows a front view of a medical garment with the outward appearance resembling a standard t-shirt in accordance with one embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions, sizing, and/or relative placement of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure. It will also be understood that the terms and expressions used herein have the ordinary meaning as is usually accorded to such terms and expressions by those skilled in the corresponding respective areas of inquiry and study except where other specific meanings have otherwise been set forth herein.

DETAILED DESCRIPTION

The following description is not to be taken in a limiting sense, but is made merely for the purpose of describing the general principles of the disclosure. The scope of the disclosure should be determined with reference to the claims. The present embodiments address the problems described in the background while also addressing other additional problems as will be seen from the following detailed description.

The present disclosure relates generally to medical garments. More specifically, the present disclosure relates to a medical garment designed to outwardly resemble a standard t-shirt, while providing easy access to medical devices attached to the wearer's chest.

Referring to FIG. 1, shown is a front view of a medical garment 100 with the outward appearance resembling a standard t-shirt in accordance with one embodiment. A body including a front portion 101 is shown, with a collar 110 configured to surround the wearer's neck at the top of the front portion 101. Adjacent to the collar 110 on each side are a first shoulder region 111 and a second shoulder region 112. On the sides of the front portion 101, a first sleeve 113 and a second sleeve 114 are attached, which are configured to surround the wearer's arms. A flap 120 in the closed position is located at the first shoulder region 111 and adjacent to the first sleeve 113. The flap 120 is positioned such that a portion of the chest area of the wearer is exposed when the flap 120 is in the open position. A first partable seam 121 is formed on the front portion 101, extending from the collar 110 and along the first shoulder region 111 to the top of the first sleeve 113. A second partable seam 122 is also formed on the front portion 101 and located at the proximal end of the first sleeve 113 and extends from the top to the bottom of the first sleeve 113. In this configuration, the flap 120 opens at the first partable seam 121 and the second partable 122 to expose the left side of the wearer's chest to provide access for medical personnel. Alternatively, the flap 120 may be positioned for access to the right side of the wearer's chest by locating the first partable seam at the second shoulder region 112 and the second partable seam at the second sleeve 114.

The configuration of the flap 120 and first and second partable seams 121 and 122 provide the benefit of easy access to medical devices used on the wearer's chest area while allowing the wearer to keep wearing the garment. Particularly, the orientation of flap 120 provides benefits in the use of central venous catheters ("CVC") such as tunneled catheters or implanted ports (port-a-caths), which are used in chemotherapy treatments or other procedures. These types of CVC devices are implanted into patients and designed to provide ready access to administer medication or fluids, draw blood, or directly obtain cardiovascular measurements, thus eliminating the need for constant needle pricks. CVCs generally comprise an access port and line that enters at a point near or on the wearer's chest and tunnels under the skin, with the exit portion inserted into a blood vessel near the wearer's heart, typically the subclavian vein or the superior vena cava. These types of devices are designed to remain in place for long periods of time, on the order of months to years, and require some type of routine maintenance during its use to prevent infection and thrombosis. The flap 120 can be opened to allow access to catheter lines and other attachments for such medical procedures or maintenance. Further, the orientation of the flap 120 and the first partable seam 121 and second partable seam 122 allow for access to the wearer's chest while the wearer is sitting down (i.e., access from above) or while laying down.

Figure 2:
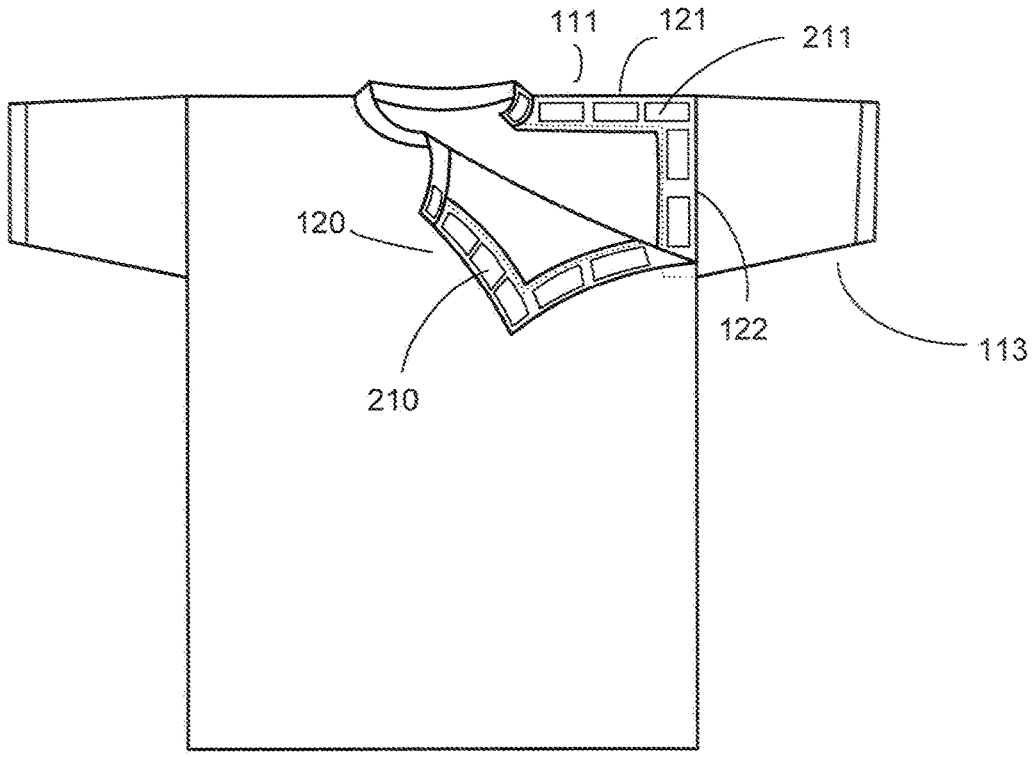
FIG. 2 shows a front view of the medical garment of FIG. 1, with a flap in the open position.

Referring to FIG. 2, shown is a front view of the medical garment 100 of FIG. 1, with the flap 120 in the open position, partially revealing an inside surface of a back portion 301. The flap 120 is opened at the first partable seam 121 and second partable seam 122, with a plurality of fasteners 210 attached to the inside surface of the flap 120 and a plurality of opposing fasteners 211 attached to the back portion 301 at the first partable seam 121 and the first sleeve 113 at the second partable seam 122. As can be seen, the flap 120 opens to expose a portion of the wearer's chest while keeping the rest of the wearer's torso covered. The configuration of the first partable seam 121 and second partable seam 122 along the first shoulder region 111 and the first sleeve 113, respectively, allow for medical procedures to be conducted on the exposed portion of the wearer's chest from above if the wearer is in the sitting position. Such a configuration also allows medical tubing, wiring, or other medical devices and components to be routed out of the garment to external machines or devices in a comfortable manner.

Figure 3:
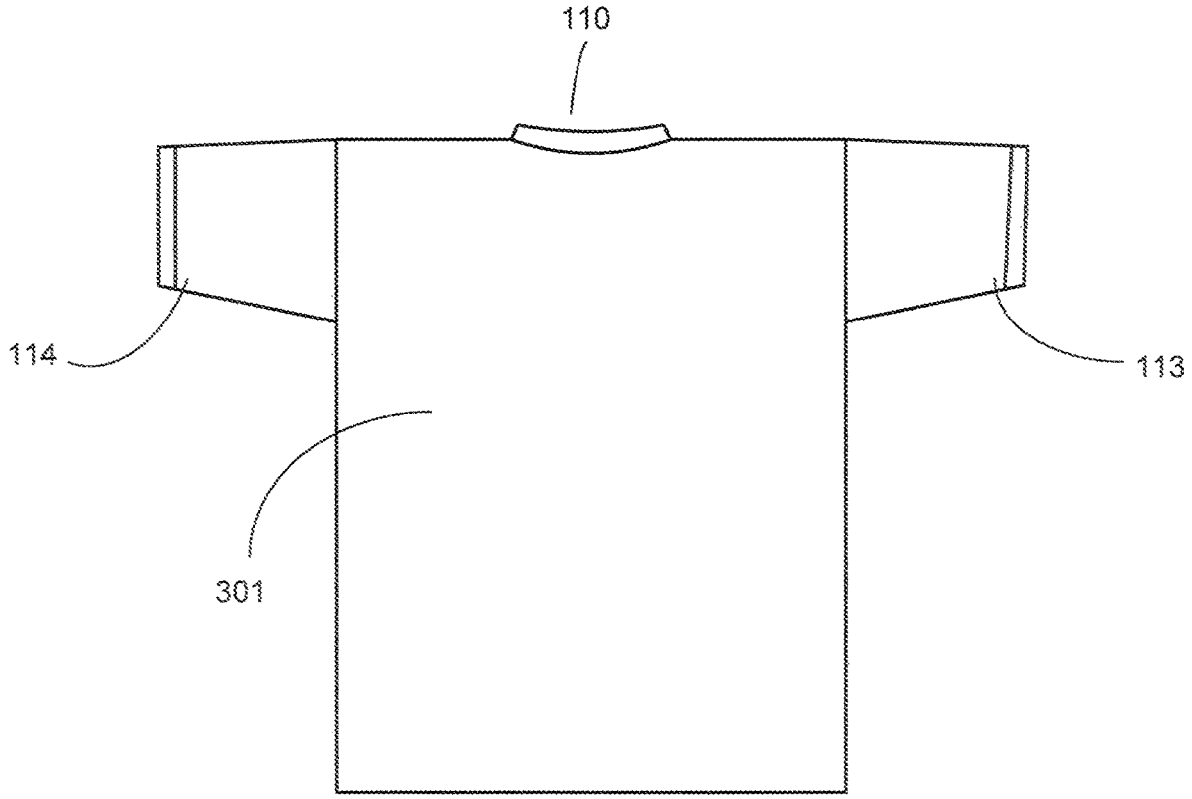
FIG. 3 is a back view of the medical garment of FIG. 1, showing the back portion, the collar, and the back of the sleeves.

Referring to FIG. 3, shown is a back view of the medical garment 100 of FIG. 1, showing the body including an outside surface of the back portion 301, the back view of the collar 110, and the back of the first sleeve 113 and second sleeve 114. Viewed from the back, the medical garment 100 resembles a standard t-shirt whether the flap 120 is in the opened or closed position.

Figure 4:
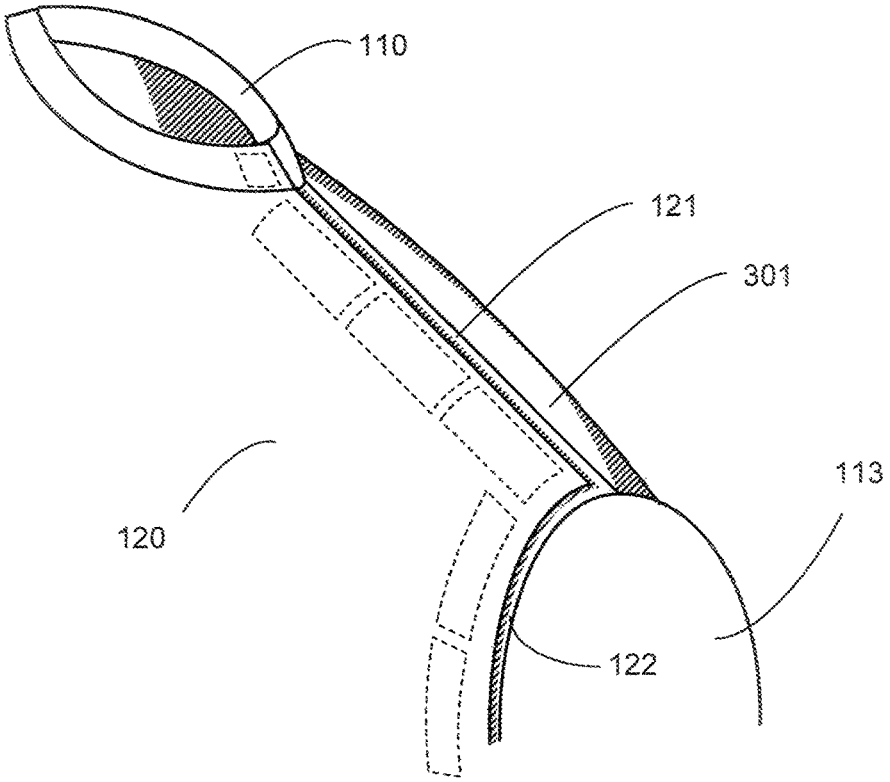
FIG. 4 is perspective view of the medical garment of FIG. 1, showing the flap in the closed position and further showing the first and second partable seams.

Referring to FIG. 4, shown is a perspective view of the medical garment 100 of FIG. 1, showing the flap 120 in the closed position and further showing the first partable seam 121 and second partable seam 122. The first partable seam 121 runs from the collar 110 and along the first shoulder region 111, ending at the top of the first sleeve 113. The second partable seam 122 runs from the top of the first sleeve 113 to the bottom of the first sleeve 113. Fasteners hold the flap 120 closed against the back portion 301 at the first partable seam 121, and at the second partable seam 122. With the flap 120 in the closed position, the first partable seam 121 is aligned with the back portion 301 and the second partable seam 122 is aligned with the first sleeve 113 in such a way that the medical garment 100 outwardly resembles a standard t-shirt, concealing the appearance of the first and second partable seams 121 and 122.

Figure 5:
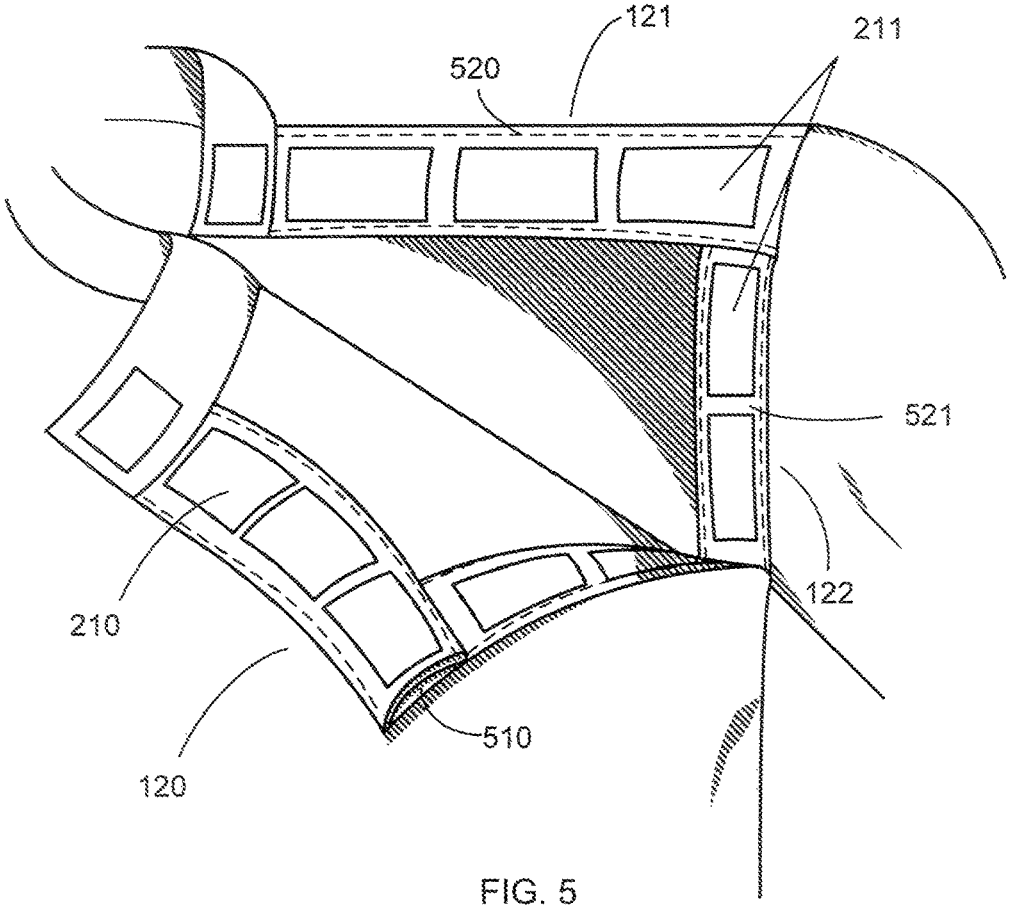
FIG. 5 is a closer view of the open flap of FIG. 2 as seen from the front, showing a first overlap area at the shoulder region and a second overlap area at the sleeve.

FIG. 5 is a closer view of the open flap 120 from FIG. 2 as seen from the front, showing a first overlap area 520 at the first shoulder region 121 and a second overlap area 521 at the first sleeve 113. Fasteners 210 and 211 are affixed to the first overlap area 520 and the second overlap area 521. The areas on the flap 120 corresponding to the first overlap area 520 and the second overlap area 521 have a reinforcement 510, shown in FIG. 5 by a folding over of material from the front portion 101 and sewing the material in place. Likewise, the first overlap area 520 at the shoulder region and second overlap area 521 at the sleeve are reinforced by folding over material from the back portion at the first partable seam 121, and a folding over material from the sleeve at the second partable seam 122. Additional or alternative methods of reinforcing first and second overlap areas 520 and 521 and reinforcement 510 on the flap 120 may also be used, such as the addition of cloth or other material, or the embedding of other material.

Some embodiments include the use of different types of fasteners 210 and 211 to hold the flap 120 in a closed position, including hook and loop fasteners, buttons, clips, or zippers. Also, the length of sleeves or number of sleeves present on the garment can be altered in accordance with alternative embodiments.

Catheter lines and other attachments can be comfortably routed from the wearer's chest to outside the garment by passing the lines through the first partable seam 121 or second partable seam 122. The use of the appropriate fasteners at the first and second partable seams 121 and 122 allows the passage of the catheter lines and attachments even while the flap 120 is in the closed position. In some embodiments, avoiding large, hard fasteners at the first and second partable seams allow a person to comfortably wear the medical garment while lying down or sleeping. The medical garment provides efficiency and comfort for the wearer, in both medical and casual capacities.

For example, the use of hook and loop or button type fasteners is suitable for certain medical procedures and situations, particularly when medical tubing or wiring must pass from the wearer's chest to external equipment. The use of the medical garment would allow such tubing or wiring attached to the wearer's chest to pass through the garment while the flap 120 is in a closed position. However, compared to the use of buttons, hook and loop fasteners would provide more comfort to the wearer when the garment is worn laying down, as the hard buttons may impinge on the wearer's neck, shoulders, and arms.

While the disclosure has been described by means of specific embodiments and applications thereof, other modifications, variations, and arrangements of the present disclosure may be made in accordance with the above teachings other than as specifically described to practice aspects of the disclosure within the spirit and scope defined by the following claims.

What is claimed is:

1. A medical garment, comprising:

a body configured to enclose at least an upper torso of a person, the body comprising a front portion at least partially attached to a back portion by a non-partable seam that extends along the body from a bottom portion of a sleeve, wherein the sleeve is configured to surround at least a portion of an arm of the person;

an opening located at a top of the body;

a flap formed in a shoulder region of the front portion and configured to open to expose a portion of the upper torso of the person;

a fastener to hold the flap in a closed position;

wherein when the flap is in a closed position, the medical garment comprises:

a first partable seam that extends from the opening to a top portion of the sleeve; and a second partable seam that extends from the top portion of the sleeve down to but not beyond the bottom portion of the sleeve where the sleeve attaches to the body;

wherein the medical garment substantially resembles a shirt, in that the sleeve is configured to extend to about the person's elbow or wrist, the body is configured to extend to about the person's waist, and, other than the flap, the body is configured to be substantially devoid of openings that would expose the upper torso.

2. The medical garment of claim 1, further comprising:

a first overlap area defined by the flap in relation to the back portion and located on the first partable seam, wherein the flap overlaps an area of the back portion at the first partable seam when the flap is in the closed position; and a second overlap area defined by the flap in relation to the sleeve and located at the second partable seam, wherein the flap overlaps an area of the sleeve when the flap is in the closed position.

3. The medical garment of claim 2, wherein the fastener is attached to an inside surface of the front portion where the flap is formed and to the first and second overlap areas.

4. The medical garment of claim 2, wherein the flap, the opening, the back portion, and the sleeve are reinforced at the first and second overlap areas.

5. The medical garment of claim 1, wherein the fastener is a hook-and-loop type fastener.

6. The medical garment of claim 4, wherein the first and second overlap areas are reinforced by overlapping fabric.

7. The medical garment of claim 4, wherein the first and second overlap areas are reinforced by folding an edge portion of the back portion to the inside surface of the back portion, folding an edge portion of the sleeve to an inside surface of the sleeve, and sewing the edge portions of the back portion and an end of the sleeve in place, and by folding an edge portion of the flap to an inside surface of the flap and sewing the edge portion of the flap in place.

8. A medical garment, comprising:

a body comprising a front portion attached to a back portion by one or more non-partable seams;

first and second sleeves on opposite sides of the medical garment, wherein the first and second sleeves are coupled to the front portion and the back portion;

a flap formed on the front portion and configured to open to expose a portion of a person, the flap comprising:

a partable seam that extends along a top of the body and a portion of a side of the body down to but not beyond a bottom part of the first sleeve where the first sleeve attaches to the body; and a fastener to hold the partable seam in a closed position;

wherein the medical garment largely resembles a shirt, in that the first and second sleeves are configured to extend to about the person's elbows or wrists, the front and back portions are configured to extend to about the person's waist, and, other than the flap, the body is configured to be substantially free of openings that would expose an upper torso of the person.

9. The medical garment of claim 8, further comprising:

a back portion overlap area; and a flap overlap area;

wherein the back portion overlap area and the flap overlap area are defined by the flap in relation to the back portion and are located at the partable seam, wherein the flap overlaps an area of the back portion at the partable seam when in the closed position.

10. The medical garment of claim 9, wherein in the closed position the fastener is attached to an inside surface of the flap on the flap overlap area and to an outside surface of the back portion overlap area.

11. The medical garment of claim 9, wherein the flap overlap area and the back portion overlap area are reinforced.

12. The medical garment of claim 8, wherein the fastener is a hook-and-loop type fastener.

13. The medical garment of claim 11, wherein the flap overlap area and the back portion overlap area are reinforced by overlapping fabric.

14. The medical garment of claim 11, wherein the back portion overlap area is reinforced by folding an edge portion of the back portion and sewing the edge portion of the back portion in place, and the flap overlap area is reinforced by folding an edge portion of the flap and sewing the edge portion of the flap in place.

15. A garment that resembles a shirt, in that when the garment is worn by a person, first and second sleeves of the garment are configured to extend to about the person's elbows or wrists, the garment is configured to extend down to about the person's waist, and other than a flap configured to open to expose an area of the person's upper torso the garment is substantially free of openings that would expose the upper torso, the garment comprising:

a body comprising a front portion attached to a back portion by a non-partable seam, wherein the first and second sleeves are attached to the front portion and the back portion;

wherein the flap comprises:

a partable seam that extends along a top of the body and that further extends along a side of the body down toward but not beyond a bottom part of the first sleeve where the first sleeve attaches to the body and where an end of the non-partable seam is located; and a fastener to hold the partable seam in a closed position.

16. The medical garment of claim 15, wherein the fastener is a hook-and-loop type fastener.

17. The medical garment of claim 15, wherein the fastener comprises a clip.

18. The medical garment of claim 15, wherein the fastener comprises a zipper.

19. The medical garment of claim 15, wherein the fastener comprises a clasp.

20. The medical garment of claim 15, wherein an area of the garment where the flap overlaps the body is reinforced.

* * * * *